US009731956B2

(12) United States Patent
Py

(10) Patent No.: US 9,731,956 B2
(45) Date of Patent: Aug. 15, 2017

(54) POUCH CONNECTOR AND RELATED METHOD

(71) Applicant: Daniel Py, Larchmont, NY (US)

(72) Inventor: Daniel Py, Larchmont, NY (US)

( * ) Notice: Subject to any disclaimer, the term of this patent is extended or adjusted under 35 U.S.C. 154(b) by 0 days.

(21) Appl. No.: 14/811,330

(22) Filed: Jul. 28, 2015

(65) Prior Publication Data

US 2016/0023885 A1 Jan. 28, 2016

Related U.S. Application Data

(63) Continuation of application No. 13/279,141, filed on Oct. 21, 2011, now Pat. No. 9,090,445.

(60) Provisional application No. 61/406,080, filed on Oct. 22, 2010, provisional application No. 61/406,937, filed on Oct. 26, 2010, provisional application No. 61/407,349, filed on Oct. 27, 2010.

(51) Int. Cl.
*B67D 3/04* (2006.01)
*B67B 7/00* (2006.01)

(52) U.S. Cl.
CPC ..... *B67D 3/043* (2013.01); *B67B 7/24* (2013.01)

(58) Field of Classification Search
CPC ..... B67D 3/043; B67B 7/24
USPC ... 222/83, 92, 105, 545, 546, 562, 563, 574, 222/566, 527, 529, 537
See application file for complete search history.

(56) References Cited

U.S. PATENT DOCUMENTS 3,406,872 A 10/1968 Fiquet et al.
4,076,147 A 2/1978 Schmit
4,112,944 A 9/1978 Williams
4,384,660 A 5/1983 Palmisano et al.
4,440,316 A 4/1984 Christine
4,473,369 A 9/1984 Lueders et al.
4,706,827 A 11/1987 Cabernoch et al.
4,798,605 A 1/1989 Steiner et al.
4,946,040 A 8/1990 Ipenburg
5,127,550 A 7/1992 Knorr
5,352,210 A 10/1994 Marrucchi
5,474,209 A 12/1995 Vallet Mas et al.
(Continued)

FOREIGN PATENT DOCUMENTS

EP 0043698 A1 1/1982
FR 2699522 A1 6/1994

OTHER PUBLICATIONS

International Search Report and Written Opinion mailed Mar. 16, 2012 for International Application No. PCT/US2011/057376. 8 pages.

(Continued)

*Primary Examiner* — Donnell Long
(74) *Attorney, Agent, or Firm* — McCarter & English, LLP

(57) ABSTRACT

A pouch connector includes a safety cap having a cap base portion and a main connector disposed opposite the safety cap. The main connector and safety cap are configured to receive a portion of a pouch therebetween. The main connector includes a piercing member for piercing the pouch, an actuating portion for actuating the piercing member and a main connector base portion. The piercing member is configured to pierce through a portion of the pouch so as to provide fluid communication between a substance inside the pouch and the interior of the main connector. A polymeric membrane is coupled to at least one of the cap base portion and the main connector base portion.

32 Claims, 11 Drawing Sheets

(56) References Cited

U.S. PATENT DOCUMENTS

| | | | | |
|---|---|---|---|---|
| 6,024,242 | A | 2/2000 | Stevenson | |
| 6,082,584 | A | 7/2000 | Stern | |
| 6,082,585 | A | 7/2000 | Mader et al. | |
| 6,109,315 | A | 8/2000 | Stern | |
| 6,659,994 | B1 | 12/2003 | Mader et al. | |
| 6,772,911 | B2 | 8/2004 | Gee et al. | |
| 7,937,836 | B2 | 5/2011 | Gabriel et al. | |
| 8,602,246 | B2 | 12/2013 | Frohwein | |
| 2001/0009258 | A1* | 7/2001 | Wakayama | B65D 37/00 222/105 |
| 2004/0178220 | A1* | 9/2004 | Smith | B67D 3/0019 222/83 |
| 2005/0045654 | A1* | 3/2005 | Kuge | B65D 75/5877 222/105 |
| 2006/0151051 | A1* | 7/2006 | Py | B65B 39/004 141/67 |
| 2006/0213935 | A1* | 9/2006 | Johnson | B65D 33/16 222/563 |
| 2007/0095857 | A1 | 5/2007 | Py et al. | |
| 2007/0194045 | A1* | 8/2007 | Py | B65B 39/004 222/105 |
| 2008/0029540 | A1* | 2/2008 | Johnson | B65D 75/5877 222/83 |
| 2009/0008417 | A1 | 1/2009 | Gunn | |
| 2009/0139949 | A1 | 6/2009 | Py et al. | |
| 2009/0179547 | A1 | 7/2009 | Auday et al. | |

OTHER PUBLICATIONS

Supplementary European Search Report mailed Mar. 12, 2015 for European Patent Application No. 11835255.8. 6 pages.

* cited by examiner

POUCH CONNECTOR AND RELATED METHOD

CROSS-REFERENCE TO RELATED APPLICATION

This patent application is a continuation of U.S. patent application Ser. No. 13/279,141, filed on Oct. 21, 2011, entitled "Pouch Connector and Related Method", now U.S. Pat. No. 9,090,445, claiming benefit pursuant to 35 U.S.C. §119(e) of U.S. Provisional Application Ser. No. 61/406,080, filed Oct. 22, 2010, entitled "Pouch Connector and Related Method", U.S. Provisional Patent Application Ser. No. 61/406,937, filed Oct. 26, 2010, entitled "Pouch Connector and Related Method", and U.S. Provisional Patent Application Ser. No. 61/407,349, filed Oct. 27, 2010, entitled "Pouch Connector and Related Method", the contents of which are all hereby expressly incorporated by reference in their entirety as part of the present disclosure.

FIELD OF THE INVENTION

The present invention relates to pouch connectors and related methods, and more particularly, to pouch connectors and related methods including piercing members for piercing the pouches and, in turn, placing the connectors in fluid communication with the pouches.

BACKGROUND INFORMATION

Aseptic packaging is widely used to prolong the shelf life of food and drink products. With conventional aseptic packaging, the product is filled and sealed in the package under aseptic conditions. It is well known from people of the art, that aseptic conditions are aimed at preventing as well as possible, contamination of the product and of the inner packaging in contact with the product, from being exposed to germs of the environment. The product is said to be aseptic, when the number of packages filled does not exceed 1 per 3,000 units. The almost irreducible rate of failure is mainly due to the fact that containers are filled open in the environment within the filling machine, which itself is cleaned aseptically.

One such prior art dispenser system that employs an aseptically filled package is shown in U.S. Pat. No. 6,024,242. The package includes a pouch that holds the food or beverage, and a flexible, open-ended tube connected to the pouch for dispensing the product therethrough. A pinch valve is used in the dispenser to pinch the open end of the tube and thereby close the tube from the ambient atmosphere. In order to dispense product, the pinch valve is released from the tube, and the product is in turn allowed to flow from the pouch and through the open end of the tube.

The prior art dispenser and packaging are limited by numerous drawbacks, including:

a. When the aseptically disinfected pouch is connected to the outflow tube the environment is aseptic, not sterile;
b. Usually a pre-sterilized tube is entered into the filling machine, through an aseptic transfer port, after removal of the outer bag in which the tube has been separately sterilized. The unpacking and the transfer are also subject to stringent regulations for preventing at most the contamination of the tubing and of the transfer in general. These components are also usually not sterile;
c. The pinch valve, on the other end of the tube, leaves a certain distal segment of the tube open to the aseptic environment (i.e., not in a sterile environment). One solution is to introduce a sterile cap to close the very end of the tube. However, when the filled pouch, attached to its aseptically connected tube, is leaving the aseptic environment of the filling machine, if one colony of germs has contaminated either transfer, connection of filling, due to the human environment, a certain number of pouches (no more than 1/3000) are contaminated for the shelf life. If the germs in the pouch are aerogen germs, the infected pouch is bloated, a visible phenomenon which allows elimination of the infected pouch. If the germs are not aerogen, it is very difficult to detect the infected pouch and remove it;
d. At user's location, the terminal cap is removed, leaving for a period of time the open tube open and subject to the contamination by the environment. In hospitals where a lot of germs are known to be resistant to antibiotics, the ingress of such a colony of germs dramatically increases the risk. Moreover, the risk further increases when the tube is to be connected to an open recipient for mixing products prior to administration to a patient. Several studies have shown that in US hospitals, only about 25% to about 50% of the products administered after connections to the patients are contaminated. When such connections are made at home, by the relatives of the patients, the contamination rate can be about 80%; and
e. The risk of contamination is also subject to the nature of the product itself. Usually drugs are rather inert product and are not prone to grow germs. However, as soon as there is water in contact with a contaminated air environment, the risk increases, especially in hospitals. If the product is a non-acid product, such as a milk-based product, it must be maintained under refrigeration to ensure the life of the product. Moreover, there is a need for an independent, sterile pouch connector which may be used with a variety of pouches.

Thus, a method to alleviate the risks discussed above including the following risks is needed:

- risk related to contamination of the aseptic environment of the filling machine, via an aseptic transfer port, for example;
- risk during connection of the tubing in the filling machine; and
- risk to contaminate the inner tube upon uncapping the tube end.

All risks related to the connection of a tubing to a pouch can be significantly reduced. The risk related to the contamination of the connector also needs to be addressed to dramatically reduce the rate of Nosocomial Infections, especially, and in general, to reduce the risk of contamination of all the products filled in pouches, whether for injection, feeding, industrial or any other kinds of uses of products delivered in pouches.

It is an object of the present invention to overcome one or more of the above-described drawbacks and/or disadvantages of the prior art.

SUMMARY OF THE INVENTION

In accordance with a first aspect, an embodiment of the present invention is directed to a connector for a sterile pouch comprising a housing including a first pouch-engaging surface engaged with a first side of the pouch forming a hermetic seal therebetween, and a second pouch-engaging surface, formed integral with the first pouch-engaging surface, and engaged with a second side of the pouch opposite the first side of the pouch and forming a hermetic seal therebetween. A penetrable and resealable member is molded in one piece with the pouch connector. The penetrable and resealable member is penetrable by a needle or injection member to sterile fill the pouch with a substance therethrough. The resulting penetration aperture is resealable to hermetically seal the sterile substance within the interior of the pouch.

In accordance with another aspect, an embodiment of the present invention is directed to a connector for a pouch defining a storage chamber. The connector comprises a housing including a piercing member, unexposed to human interaction, hermetically sealed within the housing and movable between (i) a disengaged position wherein the piercing member is not piercing the pouch, and (ii) an engaged position wherein the piercing member is piercing the pouch, and is in fluid communication with the storage chamber of the pouch. A first external pouch-engaging surface of the housing is engageable with a first side of the pouch and forms a hermetic seal therebetween. A stop member of the pouch connector includes a second pouch-engaging surface engageable with a second side of the pouch opposite the first side of the pouch, and a stop surface that stops the piercing member in the engaged position.

In accordance with another aspect, an embodiment of the present invention provides for a method for providing a pouch that can be aseptically filled. The method comprises providing a sealed, empty pouch having a first side and a second side; hermetically sealing a first pouch-engaging of a pouch connector to the first side of the pouch, and hermetically sealing a second pouch-engaging surface of the pouch connector to the second side of the pouch. The method further comprises molding the pouch connector in one piece with a penetrable and resealable member that is penetrable by a needle or injection member for aseptically filling the pouch therethrough.

In accordance with another aspect, an embodiment of the present invention provides for a method for sealing surfaces together in a sterile manner so that no germs are transported inside the pouch by the piercing member. In accordance with another aspect, the sealing process itself is between the outer device. If the sealing process is physical (e.g., ultrasonic or high frequency sealing), there is a risk of sealing both sides of the pouch at once. In some embodiments, only one side of the pouch is sealed while the other side of the pouch is not sealed around the outflow hole created by the piercing member. If the sealing process is chemical, the leach-ability of the chemical into the wall of the pouch may be propagated into the liquid contained in the pouch, and therefore the chemical and/or the pouch material is selected to prevent or substantially prevent this from occurring.

One rationale of such embodiments is based on the demonstration that physical curing of specific adhesives, such as some ultraviolet or "UV" curing liquid silicones and acrylics, can also under certain conditions of wavelength, energy and time of exposure, sterilize the contact surfaces at substantially the same time. As an example, an ultraviolet wavelength in the range of about 254 nanometers, known to damage the DNA or the RNA of germs, has been demonstrated to sterilize the surfaces sealed together by different adhesives, during the curing of the adhesives, under UV pulse light within the similar range of about 254 nanometers and about 365 nanometers. The cured liquid silicone, in a currently preferred configuration, has been demonstrated to be biocompatible and not subject to toxic levels of extractibles.

As a result, curing of the chemical adhesive, under specific controlled physical conditions, allows to both limit the seal to the pouch surface, and sterilize the interface surfaces sealed together, in a definitive way regardless of the environment that the filled pouch is going to be exposed to.

In some embodiments, the stop member is coupled to the housing, and the stop member and/or housing is movable relative to the other. In some such embodiments, a hinge is connected between the stop member and housing. In some such embodiments, the stop member and housing are formed integral with each other, and the hinge is a living hinge extending between the stop member and housing.

In some embodiments, the pouch connector further comprises a locking member coupled to the piercing member in the disengaged position and preventing movement of the piercing member from the disengaged position to the engaged position. In some such embodiments, the locking member includes a frangible portion frangibly connecting the locking member to the housing with the piercing member in the disengaged position, and the locking member is frangibly removable from the housing to permit movement of the piercing member from the disengaged position to the engaged position. Some embodiments further comprise an actuator coupled to the piercing member for moving the piercing member from the disengaged position to the engaged position. In some such embodiments, the actuator defines a manually-engageable surface that is manually engageable to move the actuator and piercing member from the disengaged position to the engaged position.

In some embodiments, the pouch connector further includes a spring coupled to the piercing member and normally biasing the piercing member in a direction toward the disengaged position. In some such embodiments, the spring is defined by a wall of the housing. In some such embodiments, at least a portion of the wall of the housing defines a bellows that forms the spring normally biasing the piercing member toward the disengaged position. In some such embodiments, the wall of the housing is made of a relatively flexible material, such as low durometer polypropylene, and has a shape providing longitudinal flexibility and resilience, such as a bellows and/or a dome spring, with the ability to store some resilience energy in radial deformation during the longitudinal motion of the housing bearing the piercing member molded preferably in a single piece with the housing and the sealing surface.

In some embodiments, the first pouch-engaging surface includes a first sealant thereon for sealing the first pouch-engaging surface to the first side of the pouch, and the second pouch-engaging surface includes a second sealant thereon for sealing the second pouch-engaging surface to the second side of the pouch. In some such embodiments, each of the first and second sealants is an adhesive, a plastic film and/or a thermally weldable surface, by sealing (via ultrasonic, high frequency, infrared or otherwise) as well as other methods known in the art.

In a preferred embodiment, a sealant adhesive, curable under high energy UV pulse light, for example, allows to seal only the interfaces between the seal surface of the device and the outer layer(s) of the pouch. The sterilization of the interface may be accomplished via a UV source during curing itself.

In accordance with another aspect, an embodiment of the present invention is directed to a combination of a pouch connector and a pouch, wherein the pouch includes a first side sealed to the first pouch-engaging surface, and a second side sealed to the second pouch-engaging surface. In some embodiments, the chamber of the pouch is empty and sterile, and the interior of each of the housing and stop member is sterile. In other embodiments, the chamber of the pouch is filled with a substance, such as any of numerous different types of fluids, the chamber is sterile, and the interior of each of the housing and stop member is sterile.

In some embodiments, the pouch connector further includes a port coupled in fluid communication with the piercing member and/or interior of the housing for receiving substance from the chamber of a pouch when the piercing member is in the engaged position. Some embodiments include a conduit coupled in fluid communication with the piercing member and/or interior of the housing, and a valve coupled in fluid communication with the conduit for controlling a flow of substance from the connector and conduit therethrough.

In accordance with another aspect, an embodiment of the present invention is directed to a method comprising the following steps:

(i) sealing a first pouch-engaging surface of a first side of a pouch connector to a first side of a pouch;
(ii) sealing a second pouch-engaging surface of a second side of a pouch connector to a second side of the pouch;
(iii) moving a piercing member on the first side of the pouch connector from (a) a disengaged position not piercing the pouch to (b) an engaged position with the piercing member piercing the first side of the pouch; and
(iv) stopping the piercing member with a stop surface on the second side of the pouch connector.

Some embodiments further comprise the steps of allowing substance to flow from a storage chamber of the pouch, through the pierced portion of the pouch, and into the pouch connector.

Some embodiments further comprise the steps of sterilizing at least a portion of each of the first and second sides of the pouch and the first and second pouch-engaging surfaces prior to the sealing steps, and maintaining the interfaces of the first and second pouch-engaging surfaces and first and second sides of the pouch, respectively, sterile after the sealing steps. Some such embodiments further comprise performing the sealing steps under an overpressure of sterile gas, such as sterile (such as by filtering) air. In an alternative embodiment, the pouch, pouch connector or both are sterilized in a chamber to maintain an aseptic condition. In each case, the method may further comprise the step of sterilizing the sealed pouch prior to filling same. Preferably, the sterilizing step includes at least one of (i) transmitting radiation, such as gamma or e-beam radiation, and (ii) transmitting a fluid sterilant, such as VHP or nitric oxide, onto the pouch and/or pouch connector. In other embodiments, the interface(s) between the pouch connector and pouch are sterilized during activation of an adhesive or other sealant located at the interface(s), such as by UV or other pulsed radiation activation, or by chemical interaction between the adhesive or other sealant and the interface surfaces of the pouch and pouch connector.

Some embodiments further comprise the following steps: prior to the moving step (i.e., step (iii)), maintaining a locking member coupled to the piercing member and preventing movement of the piercing member from the disengaged position to the engaged position, and then removing the locking member and, in turn, moving the piercing member from the disengaged position to the engaged position.

In some embodiments, the flexible pouch defines a sealed, aseptic storage chamber adapted to receive therein a substance to be stored and dispensed therefrom. In some embodiments, the flexible pouch is aseptically filled with a substance that is at least one of a food and beverage. In one such embodiment, the pouch is formed of a plastic laminate including an oxygen/water barrier and an approved food contact layer. In one such embodiment, the substance is selected from the group including lyophilized substances or liquids such as a milk-based product, milk, evaporated milk, condensed milk, cream, half-and-half, baby formula, growing up milk, yogurt, soup, ice cream, powder, juice, syrup, coffee, condiments, ketchup, mustard, mayonnaise, and coffee aroma. In at least some embodiments, the pouch is filled with a substance that is a drug, medicament or other therapy to be delivered to a patient. In another aspect, the pouch and pouch connector, in combination with a sterile connector at the other end of the tube, is used for transporting all kinds of substances including products which cannot be a source of contamination of the environment into which they are aimed at being delivered, or vice versa.

In accordance with another aspect, a significant issue for the international space station, is to prevent germs from being conveyed to the station and the astronauts, or the opposite, i.e., to prevent people on the ground from being exposed to possibly hazardous material(s) to be shipped from the station. The pouch and pouch connector may be used to store and deliver water, which is in scarce quantity and vital for astronauts who are expected to stay during long periods of time in confined station or space transportation modules.

In another aspect, the pouch and pouch connector are useful for transporting specific germ samples which cannot be contaminated by other germs or germ colonies. In these situations, the pouch connector might be sealed to an empty pouch and the pouch connector connected to a tubing or to a stopper which can be over-molded, co-molded or otherwise connected to the pouch connector. The pouch connector is used to fill the pouch with fluids, liquids, gases, or solids, preferably particles, lyophilized or powder products, which are filled according to another specific technology.

In some such embodiments, the pouch connector is used to fill a pouch, either via a stopper, or a sterile connector molded in one piece with the pouch connector. Such a sterile connector is disclosed in co-pending U.S. patent application Ser. No. 13/080,537, filed Apr. 5, 2011, entitled "Aseptic Connector with Deflectable Ring of Concern and Method", which claims priority from U.S. provisional patent application Ser. No. 61/320,857, filed Apr. 5, 2010, entitled "Aseptic Connector with Deflectable Ring of Concern and Method", which are both hereby expressly incorporated by reference in their entireties as part of the present disclosure.

Some embodiments further comprise a flexible tube coupled in fluid communication between the pouch and pouch connector. In one such embodiment, a flexible line or tube is connected to the flexible pouch and pouch connector by at least one of (i) a fitting mounted on at least one of the flexible pouch and pouch connector that frictionally engages a respective end of the tube to form a hermetic seal therebetween, (ii) a heat seal, (iii) a weld, and (iv) an adhesive.

In accordance with another aspect, an embodiment of the present invention is directed to an assembly in combination with a dispenser. The dispenser comprises a relatively rigid container receiving therein the flexible pouch, and a surface for supporting and positioning the pouch connector for dispensing substances therefrom and into another container. In one such embodiment, the dispenser further includes a pump operatively coupled to the pouch and/or pouch connector, and a control unit electrically coupled to the pump to control operation of the pump and, in turn, control dispensing of substance within the pouch, through the pouch connector, and into another container. In one such embodiment, the dispenser includes at least one pouch, and the at least one pouch includes at least one of coffee, coffee concentrate, milk, milk-based product, half-and-half, and creamer. In one such embodiment, the dispenser further includes at least one pouch containing coffee aroma.

In accordance with another aspect, an embodiment of the present invention is directed to a flexible pouch and valve assembly for aseptically storing a substance, dispensing multiple portions of the stored substance therefrom, and maintaining substance remaining in the pouch in an aseptic condition sealed with respect to ambient atmosphere. The flexible pouch and valve assembly are receivable within a relatively rigid housing and adapted to cooperate with a pump for pumping discrete portions of substance from the pouch and through the pouch connector to dispense the substance therefrom.

In one embodiment of the present invention, the pouch contains a milk-based product, and a pouch connector or means for substantially preventing micro-organisms from entering into the variable-volume storage chamber and for permitting the milk-based product to be stored and dispensed without refrigeration.

In some embodiments, the method comprises the step of aseptically filling the pouch with at least one of a milk-based product, a baby formula, and a water-based product. One such embodiment further comprises the step of maintaining the milk-based product, baby formula, or water-based product substantially preservative-free substantially throughout the filling and dispensing of the product. One such embodiment further comprises the step of maintaining the milk-based product, baby formula, or water-based product substantially at ambient temperature throughout the shelf-life and dispensing of multiple servings of the product from the pouch.

Some embodiments further comprise the steps of: (i) providing a flexible tube coupled on one end in fluid communication with the pouch and/or pouch connector, and a pump in the form of a peristaltic pump; and (ii) engaging with the peristaltic pump an external portion of the flexible tube and pumping discrete portions of fluid therethrough.

One advantage of certain embodiments of the present invention is that it enables a pouch connector to be connected to the pouch either before or after filling the pouch. Another advantage certain embodiments of the present invention is that the connector maintains the chamber of the pouch hermetically sealed throughout the shelf-life, storage and/or non-use of the pouch, but allows the connector to be readily placed in fluid communication with the chamber of the pouch by moving the piercing member from the disengaged position to the engaged position. Yet another advantage of currently preferred embodiments of the present invention is that they can specifically eliminate any risk for the piercing member, also referred to as a "spike", from being contaminated by the hands of the operator. Yet another advantage of certain embodiments of the present invention is that the pouch connector can be connected to a dispensing line or other conduit which, in turn, can be connected to a sterile connector or other one-way valve to control dispensing of the fluid or other substance therethrough.

One advantage of some currently preferred embodiments of the present invention is that the pouch connector can hermetically seal the product in the pouch throughout, for example, the shelf life of the product. The pouch connector is able to maintain the interior of the pouch in a sterile condition.

Another advantage some embodiments of the pouch connector, especially if it is applied to the pouch after filling, is that the same filling machine traditionally used for filling pouches, can be used, even simplified, by mere disconnection of the sealing fixture that some of the machines have, to seal the port of the connector inside of the pouch prior to filling. As a consequence, the safety level of the existing filling machine can be increased and no significant additional capital expenses are needed to use the pouch connector.

Another advantage some embodiments of the pouch connector is to lower the rate of contamination of existing filling machines and the failure rate of the pouch aseptic filling process. Moreover, when the pouch connector is sealed to a tube in combination with a non-contamination sterile connector, the rate of nosocomial infection should also be dramatically lowered when the pouch connector and deflectable ring of concern valve are used in combination as in a currently preferred configuration.

Other advantages of the present invention and/or of the currently preferred embodiments thereof will become readily apparent in view of the following detailed description and accompanying drawings.

DETAILED DESCRIPTION OF THE INVENTION

Figure 1:
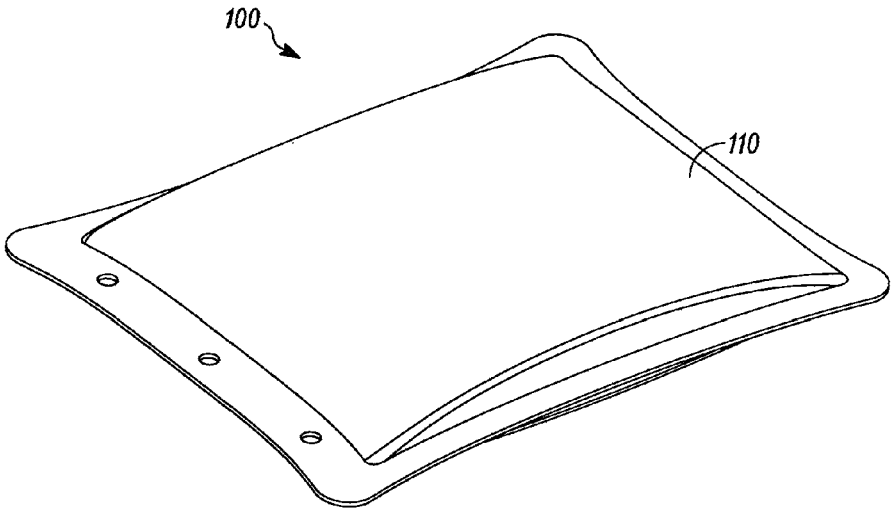
FIG. 1 is a perspective view of a pouch filled with a substance, such as a liquid food or beverage.

In FIG. 1, a first embodiment of a pouch according to the present invention is indicated generally by the reference numeral 100. The pouch 100 is used to hermetically seal with respect to the ambient atmosphere a substance 110 within the pouch 100 for later dispensing. The substance 110 may take the form of any of numerous different products that are currently known, or that later become known, including without limitation any of numerous different food and beverage products, such as milk-based products, including milk, evaporated milk, condensed milk, cream, half-and-half, baby formula, growing up milk, yogurt, soup, low acid fluids, no acid fluids, and any of numerous other liquid nutrition products, ice cream (including dairy and non-diary, such as soy-based ice cream), juice, syrup, coffee, condiments, such as ketchup, mustard, and mayonnaise, gases, such as coffee aroma, and biological or biopharmaceutical products, such as drugs, medicaments, vaccines, monoclonal antibodies and gene therapies.

The pouch 100 can be configured and formed using a variety of materials depending on the desired application or field of use. In one embodiment, the material of the pouch 100 is an oxygen/water barrier material. An exemplary such material is a plastic laminate with an approved food contact material layer. In one such embodiment, the material is a heat-sealable film including an oxygen/water barrier layer and, preferably, an outer layer exhibiting appropriate wear and flexibility properties. Examples of suitable outer layers are nylon, either linear or biaxially orientated, polyethylene, polypropylene, and polystyrene. Examples of oxygen/water barrier materials are ethylene vinyl alcohol (EVOH) and silicon oxide. An exemplary heat-sealable material is polyethylene, such as linear low-density, ultra linear low-density, high-density or metallocene catalyzed polyethylene. An exemplary pouch material is a laminate including a nylon co-polymer, on the outside, EVOH, and metallocene catalyzed polyethylene on the inside, wherein the layers of the laminate are adhered together in a manner known to those of ordinary skill in the pertinent art.

The pouch 100 may be initially filled with a substance 110 as described above using any number of techniques known in the art. In some embodiments, the pouch 100 is filled using filling techniques such as those found in U.S. patent application Ser. No. 12/901,420, filed Oct. 8, 2010 and entitled "Device With Co-Molded Closure, One-Way Valve and Variable-Volume Storage Chamber and Related Method." The pouch 100 may also be filled using methods such as the INTASEPT™ technology whereby hermetically sealed membranes provide 'tamper evident' protection, before and after filling. These double membranes also maintain the high barrier properties of the pouch. Before filling, the top membrane is completely sealed and the internal membrane is partially sealed. During filling, the internal membrane is completely heat-sealed from below. After filling, the internal membrane is fully sealed, providing tamper-evidence for the filled pack.

Figure 2:
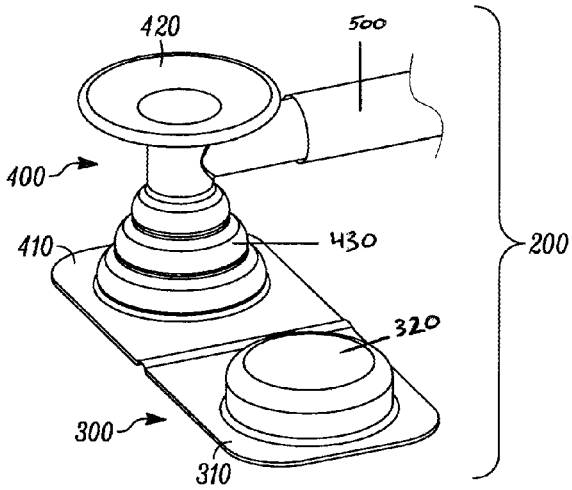
FIG. 2 is a perspective view of a first embodiment of a pouch connector of the present invention including a safety cap and a main connector for coupling to the filled pouch of FIG. 1.

With reference to FIG. 2, a pouch connector 200 is attached or otherwise adapted for coupling to the pouch 100. The pouch connector 200 comprises a safety cap 300 and a main connector 400. The pouch connector 200 may be useful in dispensing a substance 110 within pouch 100, or filling substance 110 into pouch 100 as will be described in greater detail with reference to FIGS. 6A-8. As shown in FIG. 2, the pouch connector 200 is formed of two main components, a safety cap 300 and a main connector 400. In some embodiments, the safety 300 and the main connector 400 are formed of the same material. In at least some embodiments, the safety cap 300 and the main connector 400 are formed of a different material. In at least some embodiments, the safety cap 300 and/or main connector 400 is formed from a thermoplastic or other plastic material.

The main connector 400 of pouch connector 200 is adapted to fixedly secure or otherwise attach to a portion of the pouch 100. In some embodiments, the main connector 400 is coupled to one side of pouch 100 after the pouch has been filled with a substance 110. In some other embodiments, the main connector 400 is coupled to one side of pouch 100 before the pouch has been filled with a substance 100. The main connector 400 includes a base portion 410, a body portion 430, a piercing member 450 and an actuating portion 420. The base portion 410 is a flexible pouch-engaging surface which couples to a side of pouch 100. Connected to the base portion 410 is body portion 430. Preferably, body portion 430 is a housing formed of a spring-like thermoplastic material that is normally biased towards an uncompressed disengaged position, and compressible upon actuation of main connector 400 into an engaged position. The main connector 400 further includes a piercing member 450 having an angled piercing surface 460 and a piercing tip 470, for piercably engaging pouch 100 when main connector 400 is actuated. The piercing member 450 may be formed of a plastic or thermoplastic material. In some embodiments, the piercing member 450 is formed of a metal. In at least some other embodiments, the piercing member 450 includes both plastic and metal portions. It will be understood that the piercing member 450 may alternatively include any needle, pin, spike, dowel, nail, screw or any other sharp or pointed member configured to pierce, slash, cut, slit or otherwise provide a hole or passageway through a portion of pouch 100. The piercing member 450 of the main connector 400 is further coupled to the actuating portion 420 configured to drive the piercing member 450 when engaged by the user. Actuator portion 420 defines a manually-engageable surface that is manually engageable to move the actuator portion, and thus compress body portion 430, with piercing member 450 within, from a disengaged position, wherein the piercing member 450 has not pierced pouch 100, to an engaged position, wherein the piercing member 450 pierces pouch 100.

As seen in FIG. 2, the pouch connector 200 further includes a safety cap 300. Preferably the safety cap is a stop member. In some embodiments, the safety cap 300 includes a base portion 310, having a pouch-engaging surface for coupling the safety cap 300 to a portion of one side of the pouch 100. Safety cap 300 also includes a recessed stop surface 320 relative to base portion 310. Safety cap 300 may further be configured to mate with or couple to a portion of main connector 400. In some embodiments, safety cap 300 is formed with a predetermined diameter. For example, safety cap 300 may be configured having a diameter capable of receiving piercing member 450 of main connector 400. In at least some embodiments, safety cap 300 and main connector 400 are complementary. In some embodiments, safety cap 300 is formed at least partially of a material that is sufficiently resilient to withstand piercing member 450 so that piercing member 450 is not able to pierce through stop surface 320 at the point of contact between piercing tip 470 and stop surface 320. In some other embodiments the safety cap 300 may be any of numerous different devices, currently known or that later become known. For example, safety cap 300 may be, but is not limited to, a connector, an inflow port, outflow port, or a valve, such as those disclosed in U.S. patent application Ser. No. 13/080,537, filed Apr. 5, 2011, entitled "Aseptic Connector with Deflectable Ring of Concern and Method", U.S. patent application Ser. No. 13/102,884, filed May 6, 2011, entitled "Dispensing Machine Valve and Method", and U.S. patent application Ser. No. 13/213,969, filed Aug. 19, 2011, entitled "Connector and Related Method", which are hereby expressly incorporated by reference in their entireties as part of the present disclosure.

Figure 3:
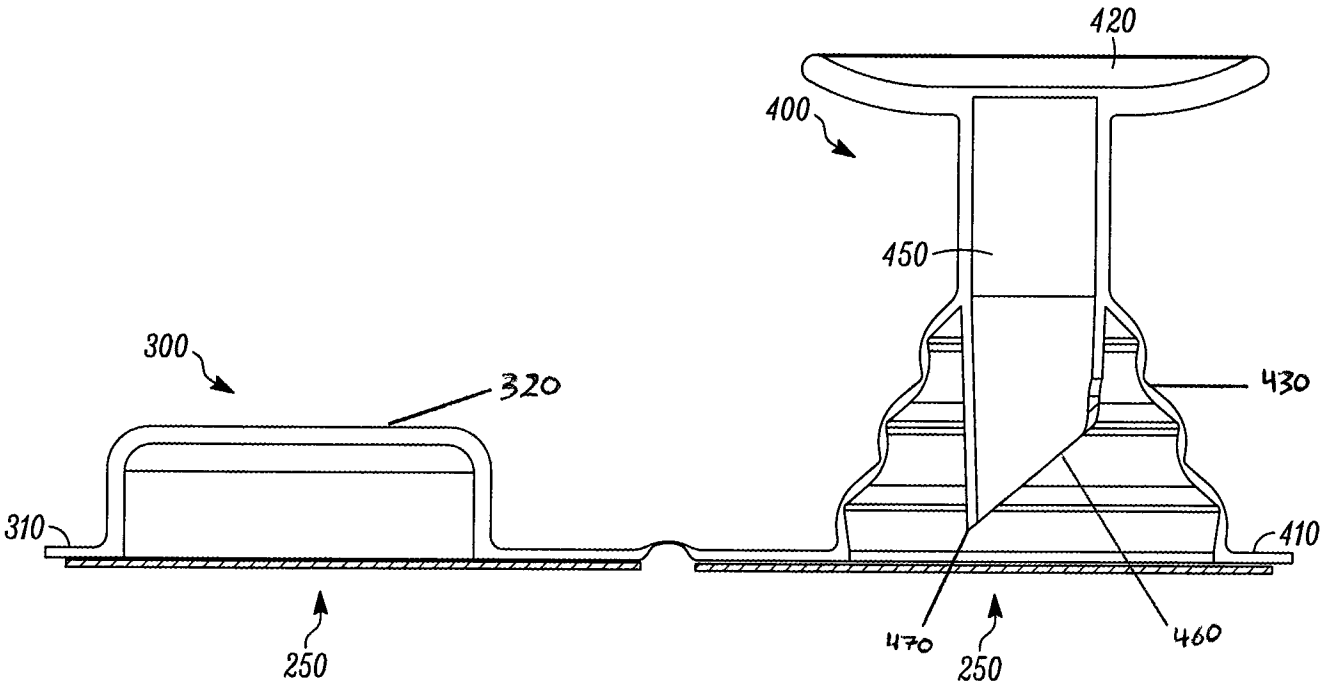
FIG. 3 is a perspective, cross-sectional view of the pouch connector of FIG. 2 showing the piercing member in the disengaged position, and after the application of polymeric membranes to the safety cap and main connector.

FIG. 3 is a schematic side view of the pouch connector of FIG. 2 after the application of polymeric membranes 250 to the safety cap 300 and main connector 400. As seen in FIG. 3, after forming the safety cap 300 and the main connector 400, a polymeric membrane 250 may be applied across the face of the respective base portions, 310 and 410 of safety cap 300 and main connector 400, thereby enclosing the exposed interiors of the safety cap and the main connector. One side of the polymeric membrane 250 thereafter also define a pouch-engaging surface. The polymeric membrane 250 may be coupled to the base portions 310, 410 using heat sealing, ultrasonic or high frequency sealing or any mechanical or chemical method for welding, gluing, crimping, adhering or otherwise coupling the polymeric membrane 250 with the base portions 310, 410 together as known in the art. In at least some embodiments, the polymeric membrane 250 includes polyethylene or other similar polymer. The polymeric membrane 250 is disposed across the entire face of the safety cap 300 and main connector 400 such that safety cap 300 and main connector 400 both define interiors that are aseptic, empty and hermetically sealed. In some embodiments, the pouch connector 200 is first sterilized and then the polymeric membranes 250 applied. In at least some other embodiments, the pouch connector 200 is sterilized after the application of the polymeric membranes 250. In such embodiments, the polymeric membranes 250 prevent contamination of the pouch connector 200 after sterilization.

In at least some embodiments, the safety cap 300 and the main connector 400 are sterilized upon coupling of the polymeric membranes 250. The pouch connector 200 is preferably sterilized prior to assembly by, for example, applying radiation, such as gamma, ultraviolet or e-beam radiation thereto, or another type of sterilant, such as vaporized hydrogen peroxide ("VHP"). It will be understood that sterilization may be performed during formation of the pouch connector 200, during assembly of the pouch connector 200 to the pouch 100 and/or after assembly of the pouch connector 200 to pouch 100. In embodiments where sterilization is performed on the pouch 100, the sterilization method should be chosen so that a substance 110 which may be contained in the pouch 100 would not be adversely affected.

The apparatus and methods for sterilizing the pouch connector may take the form of any of the apparatus and methods disclosed in the following commonly assigned patents and patent applications which are hereby expressly incorporated by reference as part of the present disclosure: U.S. patent application Ser. No. 10/766,172, filed Jan. 28, 2004, entitled "Medicament Vial Having A Heat-Sealable Cap, And Apparatus and Method For Filling The Vial", which is a continuation-in-part of similarly titled U.S. patent application Ser. No. 10/694,364, filed Oct. 27, 2003, which is a continuation of similarly titled co-pending U.S. patent application Ser. No. 10/393,966, filed Mar. 21, 2003, which is a divisional of similarly titled U.S. patent application Ser. No. 09/781,846, filed Feb. 12, 2001, now U.S. Pat. No. 6,604,561, issued Aug. 12, 2003, which, in turn, claims the benefit of similarly titled U.S. Provisional Application Ser. No. 60/182,139, filed Feb. 11, 2000; and U.S. Provisional Patent Application No. 60/443,526, filed Jan. 28, 2003; and similarly titled U.S. Provisional Patent Application No. 60/484,204, filed Jun. 30, 2003; U.S. patent application Ser. No. 10/655,455, entitled "Sealed Containers And Methods Of Making And Filling Same", filed Sep. 3, 2003, which, in turn, claims the benefit of similarly-titled U.S. Provisional Patent Application No. 60/408,068 filed Sep. 3, 2002; U.S. Provisional Patent Application No. 60/551,565, filed Mar. 8, 2004, titled "Apparatus and Method for Molding and Assembling Containers with Stoppers"; U.S. patent application Ser. No. 10/600,525 filed Jun. 19, 2003 titled "Sterile Filling Machine Having Needle Filling Station Within E-Beam Chamber", which, in turn, claims the benefit of similarly-titled U.S. Provisional Application No. 60/390,212 filed Jun. 19, 2002; U.S. patent application Ser. No. 10/983,178 filed Nov. 5, 2004 titled "Needle Filling and Laser Sealing Station", which, in turn, claims the benefit of similarly-titled U.S. Provisional Patent Application No. 60/518,267 filed Nov. 7, 2003 and similarly-titled U.S. Provisional Patent Application No. 60/518,685 filed Nov. 10, 2003; U.S. Provisional Patent Application No. 60/550,805 filed Mar. 5, 2004 titled "Apparatus for Needle Filling and Laser Resealing"; and U.S. patent application Ser. No. 08/424,932 filed Apr. 11, 1995 now U.S. Pat. No. 5,641,004 issued Jun. 24, 1997 titled "Process for Filling a Sealed Receptacle Under Aseptic Conditions."

Figure 8:
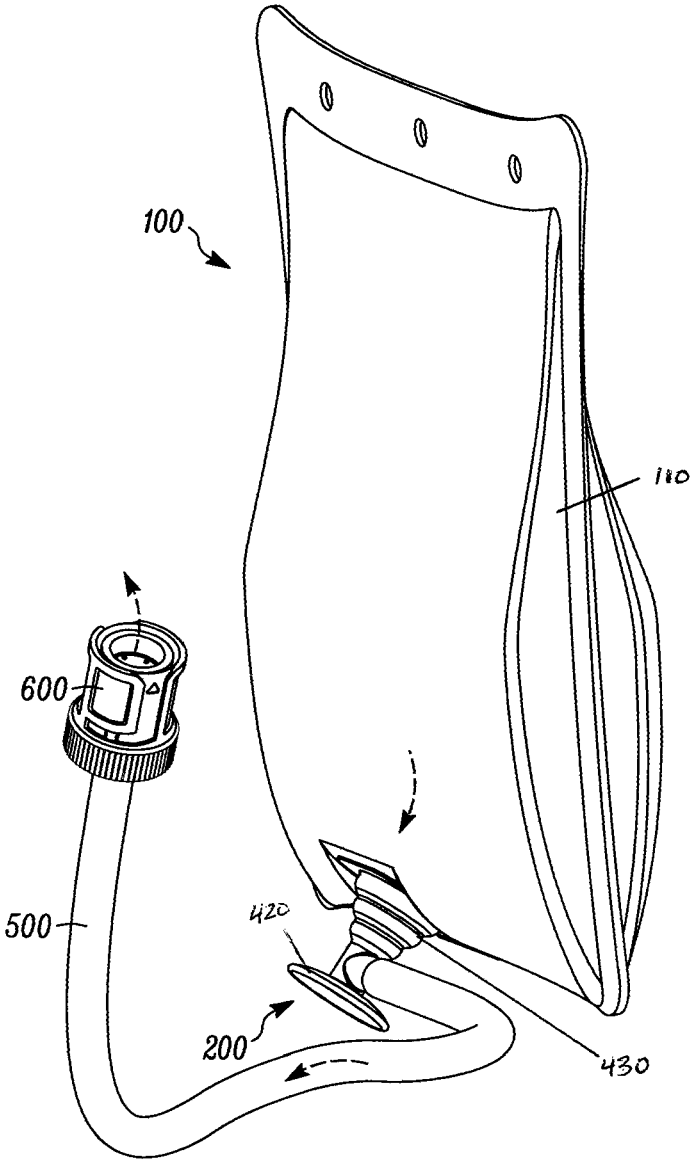
FIG. 8 is a perspective view of the assembled filled pouch and pouch connector including a dispensing line connected on one end to the outlet portion of the pouch connector and connected on the other end to a sterile connector and/or one-way valve to control the flow of fluid or other substance from the pouch therethrough.

As shown in FIG. 2, in some embodiments the main connector 400 is further coupled to a dispensing line 500, which may terminate, at its distal end, in a valve (shown in FIG. 8). In some embodiments, the main connector 400 is coupled directly to an outlet valve 600 without a dispensing line positioned therebetween. As may be recognized by those of ordinary skill in the pertinent art based on the teachings herein, any of numerous valves or other devices, that are currently known or later become known, may be connected to the distal end of the dispensing line or otherwise coupled in fluid communication with pouch connector 200. For example, any of the connectors or valves disclosed in U.S. patent application Ser. No. 13/080,537, filed Apr. 5, 2011, entitled "Aseptic Connector with Deflectable Ring of Concern and Method", U.S. patent application Ser. No. 13/102,884, filed May 6, 2011, entitled "Dispensing Machine Valve and Method", and U.S. patent application Ser. No. 13/213,969, filed Aug. 19, 2011, entitled "Connector and Related Method", may be employed.

In at least some embodiments, the main connector 400 is further connected to a pump (not shown) for dispensing the substance through the main connector 400. The pump may be a conventional peristaltic pump that is rotatably driven to pump substance 110 from the reservoir pouch 100, through the pouch connector 200, and into a receiving container or other receptacle. Alternatively, the pouch 100 may be used in combination with any of numerous different pumps, such as electrically-actuated, manually-actuated, or pedal actuated pumps, or may be used with dispensers that employ pressurized air or other gas to pump the fluid through the valve, that are currently known, or that later become known.

Figure 4A:
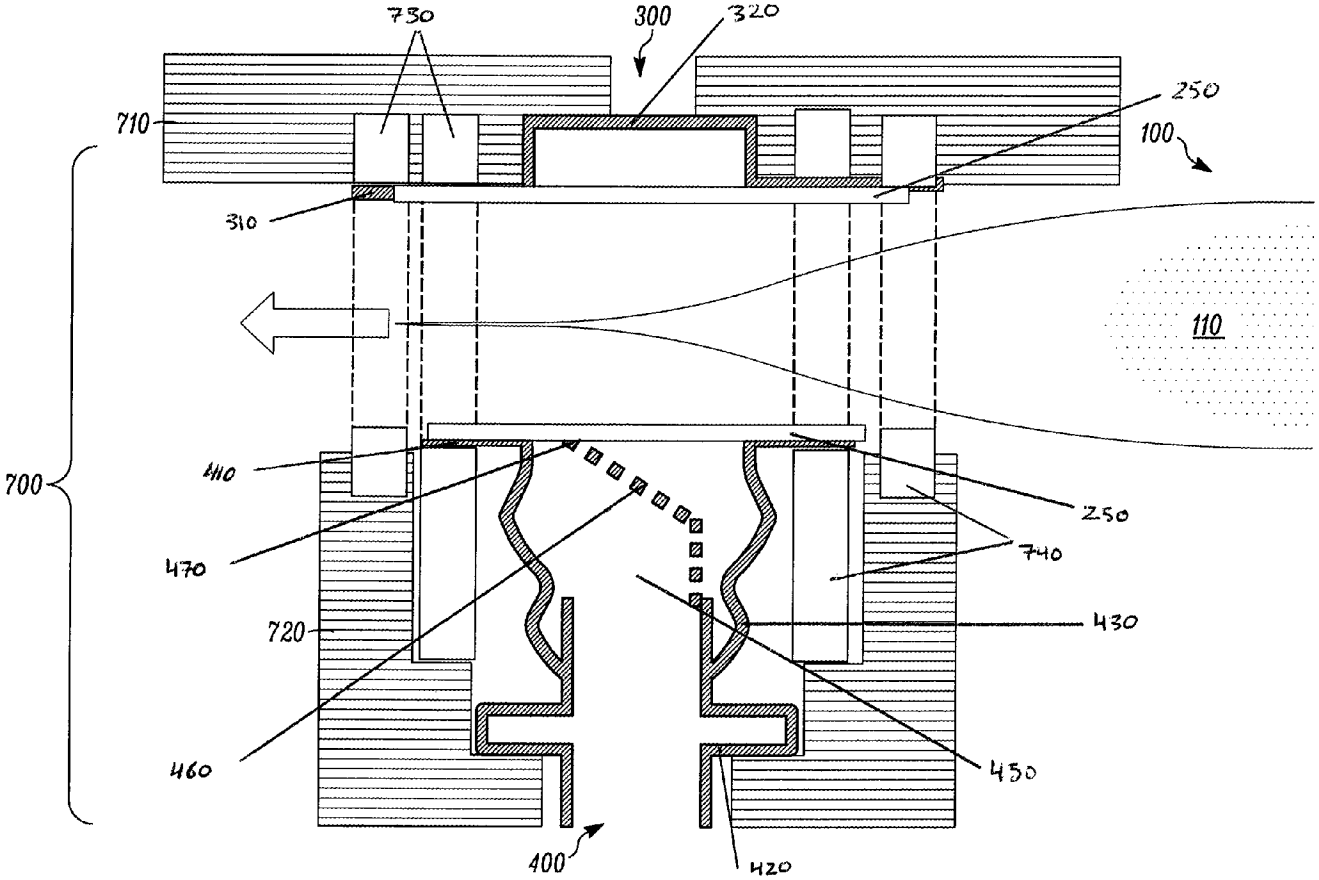
FIG. 4A is a schematic cross-sectional view of one embodiment of an installation assembly whereby a pouch connector including a safety cap and a main connector is initially positioned within the installation assembly for attachment to a filled pouch.

FIG. 4A is a schematic cross-sectional view of an installation assembly whereby a pouch connector 200 including a safety cap 300 and a main connector 400 is initially positioned within the installation assembly 700 for coupling to a filled pouch 100. As seen in FIG. 4A, the installation assembly includes a pair of plates for holding the safety cap 300 and the main connector 400 in position for coupling to the filled pouch 100. Each of the plates is configured to position a portion of the pouch connector 200 about a portion of the filled pouch 100 as shown in FIG. 4A. In some embodiments, the installation assembly includes a first, upper plate 710 for holding the safety cap 300 and a second, lower plate 720 for holding the main connector 400. The upper plate 710 may be in the form of a vacuum sucking cup to maintain the safety cap 300 in position against the force of gravity. The lower plate 720 may be positioned directly underneath the upper plate 710 with a portion of the filled pouch disposed therebetween. It will be understood that the assembly need not be configured in a vertical configuration and that a horizontal alignment of the plates 710, 720 may also be possible. The assembly may further include a sealer. In some embodiments, each of the plates 710, 720 includes independent sealers 730 and 740 respectively. In some embodiments, the sealer includes a heat sealer or high frequency sealer capable of sealing the safety cap 300 and/or the main connector 400 to the pouch 100. It will be understood that any method of coupling the parts may be used such as described above with respect to the polymeric membranes 250 including welding, gluing, crimping, or adhering.

Figure 4B:
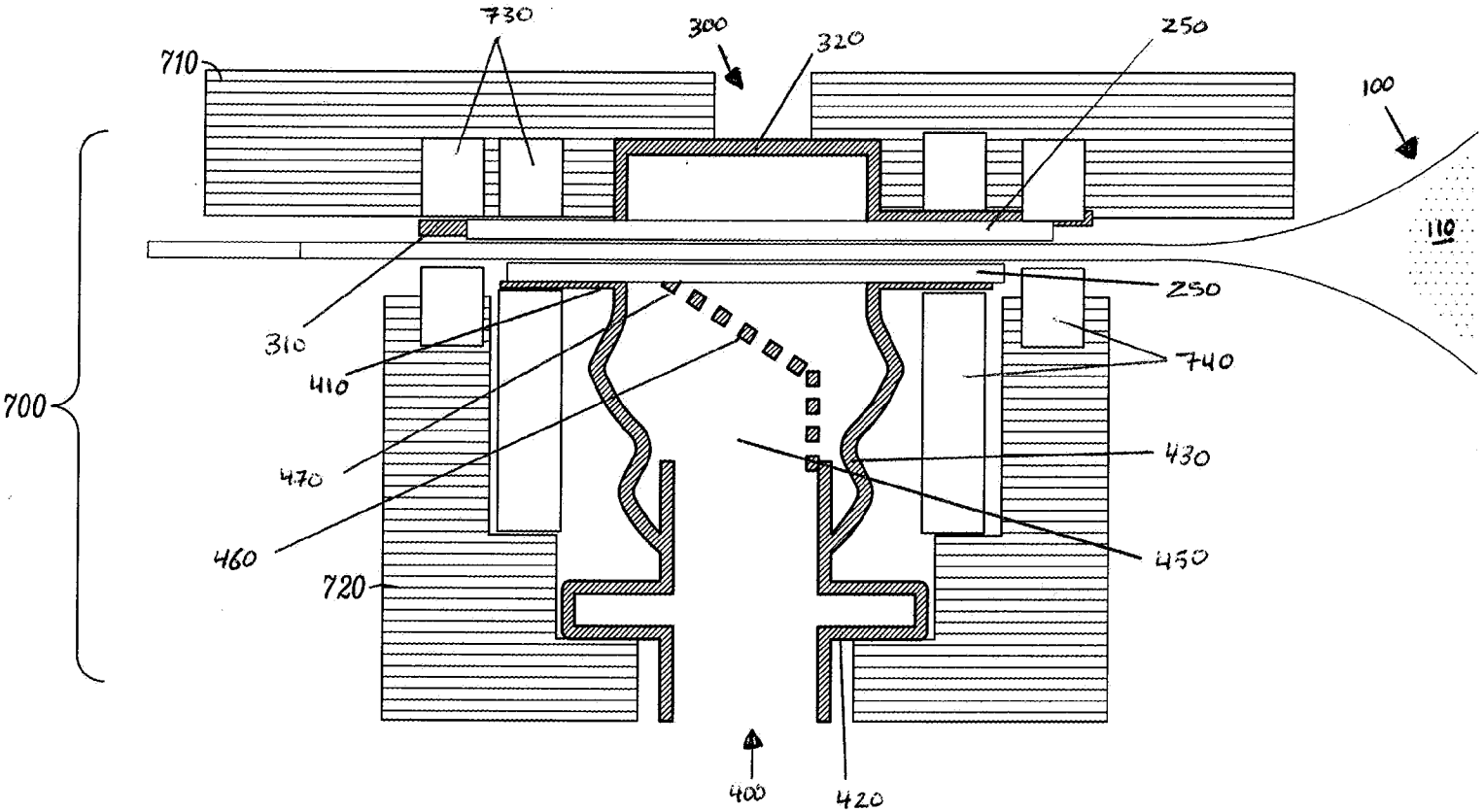
FIG. 4B is a schematic cross-sectional view of the installation assembly of FIG. 4A in a second position where the safety cap and main connector is attached to the filled pouch.
Figure 4C:
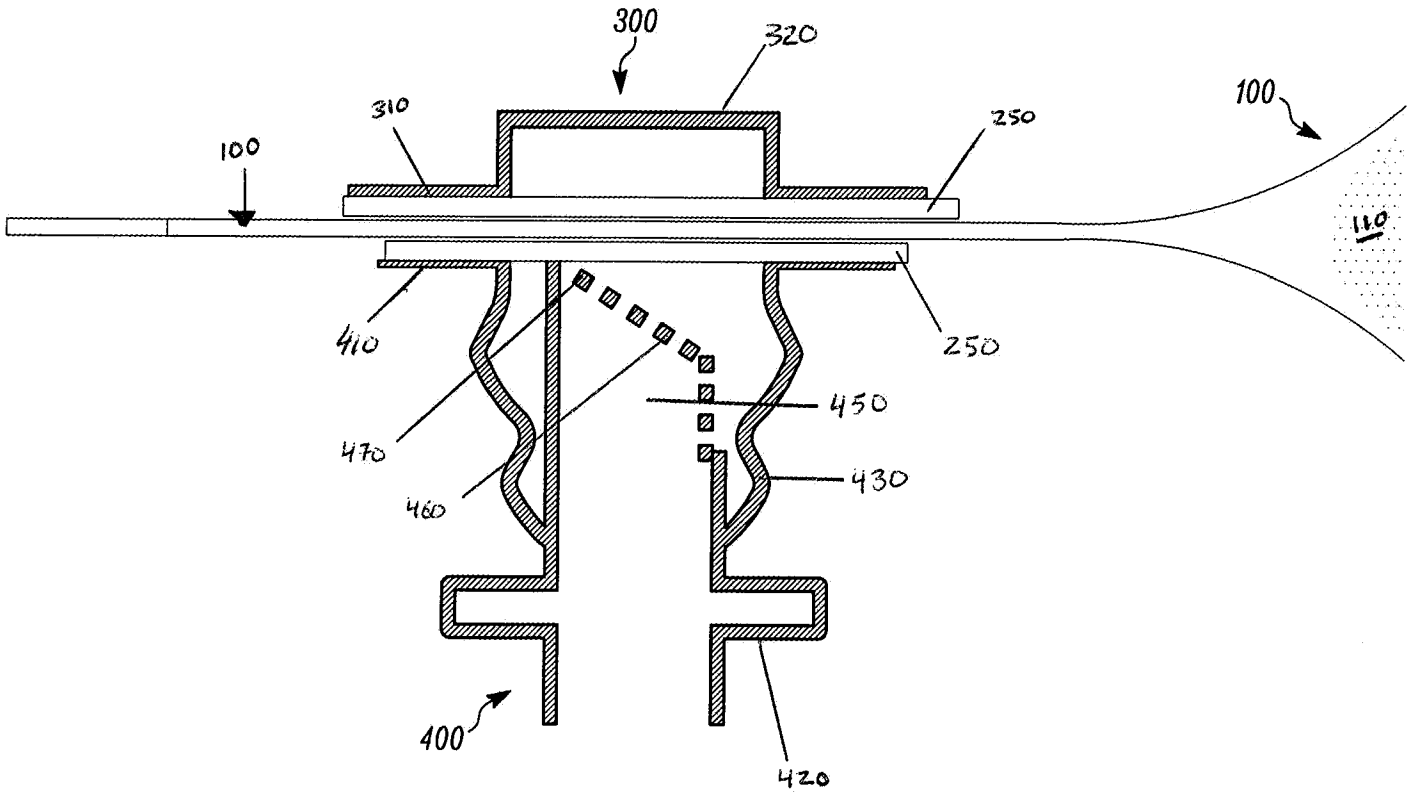
FIG. 4C is a schematic cross-sectional view of the assembled filled pouch and pouch connector, wherein the piercing member is in the disengaged position, but the locking member is removed and the piercing member is ready to be actuated into the engaged position to pierce the pouch.

FIG. 4B is a schematic cross-sectional view of the installation assembly of FIG. 4A in a second position where the safety cap 300 and main connector 400 is coupled to a filled pouch 100. As seen in FIG. 4B, the upper and lower plates 710 and 720 are moved toward each other such that the safety cap 300 and the main connector 400 are pressed against surfaces of the filled pouch 100. Sealers 730 and 740 or the equivalent are then used to bind the safety cap 300 to one surface of the pouch 100 and the main connector 400 to another surface of the pouch 100. The assembled pouch 100 and pouch connector 200 may then be removed from the installation assembly as seen in FIG. 4C to yield a pouch 100 having a pouch connector 200 that is ready for use. It will be understood that the pouch connector 200 may be coupled to the pouch 100 according to the same teachings herein before the pouch 100 is filled with a substance 110.

Figure 5A:
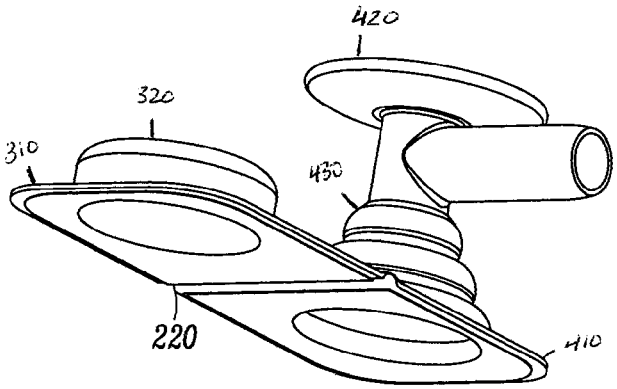
FIG. 5A is a perspective view of a unitary pouch connector including a living hinge formed between the integrally formed main connector and safety cap.
Figure 5B:
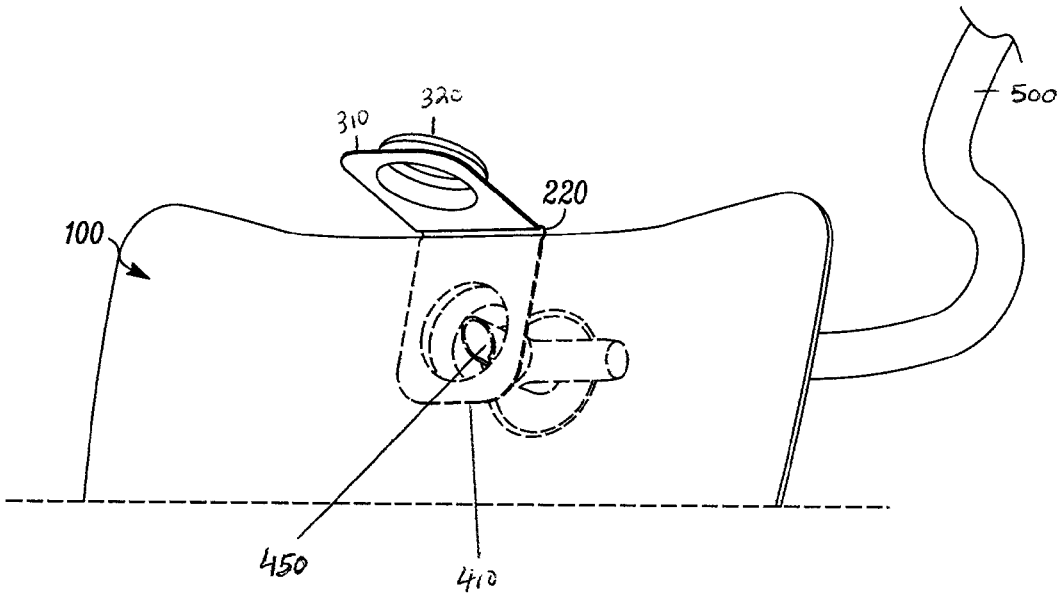
FIG. 5B is a perspective view of the pouch connector of FIG. 5A being coupled to a filled pouch.

FIGS. 5A and 5B are schematic perspective views illustrating an alternative method for assembling a pouch connector 200 to a filled pouch 100. As seen in FIG. 5A, the pouch connector 200 including the safety cap 300 and the main connector 400 may be unitarily formed with a single base portion having a score mark 220. The pouch connector 200 may be folded across the score mark 220 so that the safety cap 300 and the main connector 400 face each other with a portion of the pouch 100 being disposed therebetween as shown in FIG. 5B. In some embodiments, a spray-on adhesive may be applied to the base portions of the safety cap 300 and main connector 400. UV radiation or other forms of radiation or energy may then be applied, at any of numerous wavelengths known in the art, to a portion of or the entire pouch connector 200 to cure the assembly. In some embodiments, the UV radiation or other forms of radiation or energy further may be applied to sterilize the surfaces of the pouch connector 200 including the base portions 310, 410 which are in contact with the filled pouch 100. The safety cap 300 and the main connector 400 may be adhered and/or cured together or separately. In some embodiments, the safety cap 300 and main connector 400 include semi-transparent portions that allow passage of light for adequate curing and sterilization of the assembled pouch 100 and pouch connector 200.

Figure 6A:
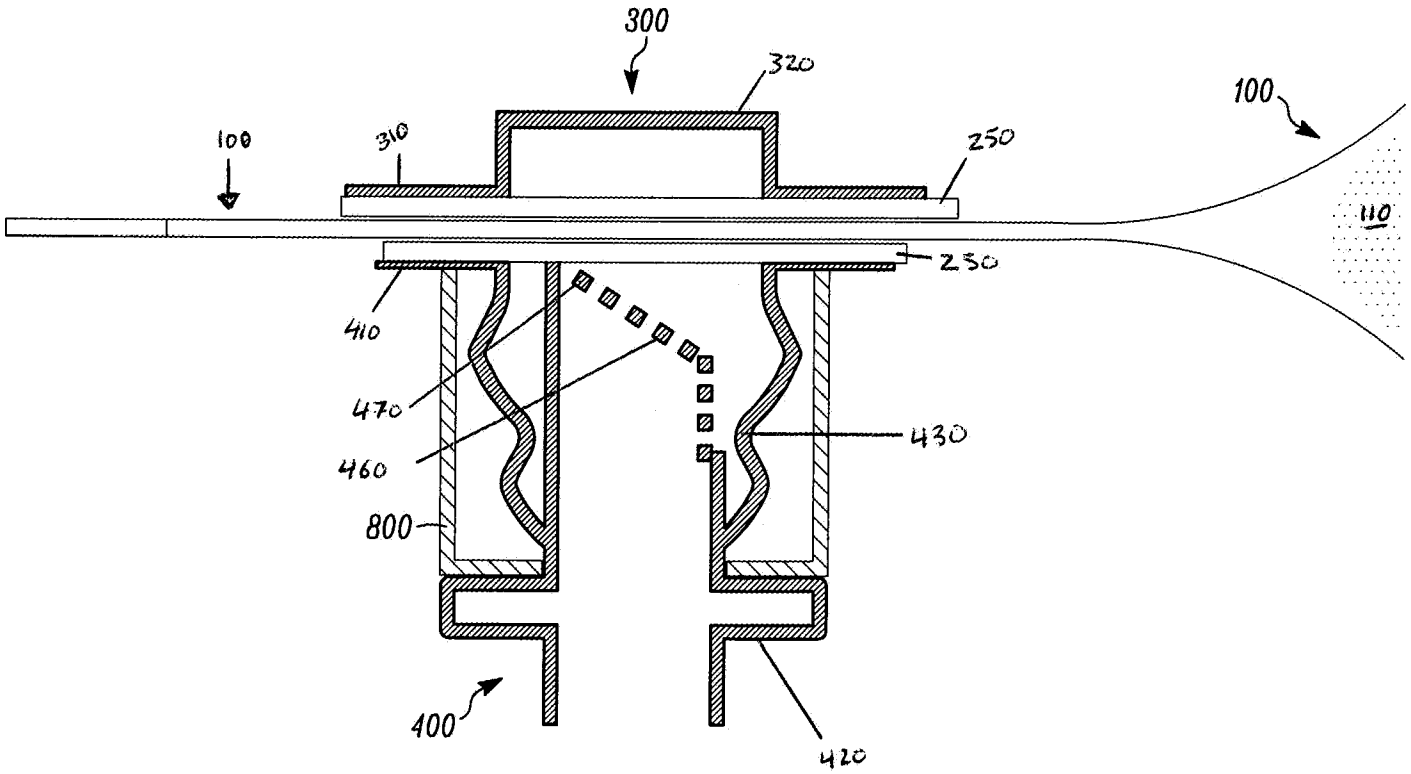
FIG. 6A is a schematic cross-sectional view of an assembled filled pouch and pouch connector, the pouch connector having a removable safety or locking ring.

FIG. 6A is a cross-sectional side view of an assembled filled pouch 100 and pouch connector 200. Because the pouch connector 200 is designed to be easily actuated by a user, the pouch connector 200 includes safety features to deter accidental or undesirable actuation. In some embodiments, the safety feature includes a locking member or safety ring 800 for preventing the pouch 100 from being perforated during shipment, handling or storage. As seen in FIG. 6A, the safety ring 800 is a substantially cylindrical member disposed between the actuating portion 420 and the pouch 100 to prevent the piercing member 450 from moving axially toward the pouch. The safety ring 800 may be formed of any suitable plastic or metal so long as the safety ring 800 is capable of withstanding a predetermined axial force or compression.

Figure 6B:
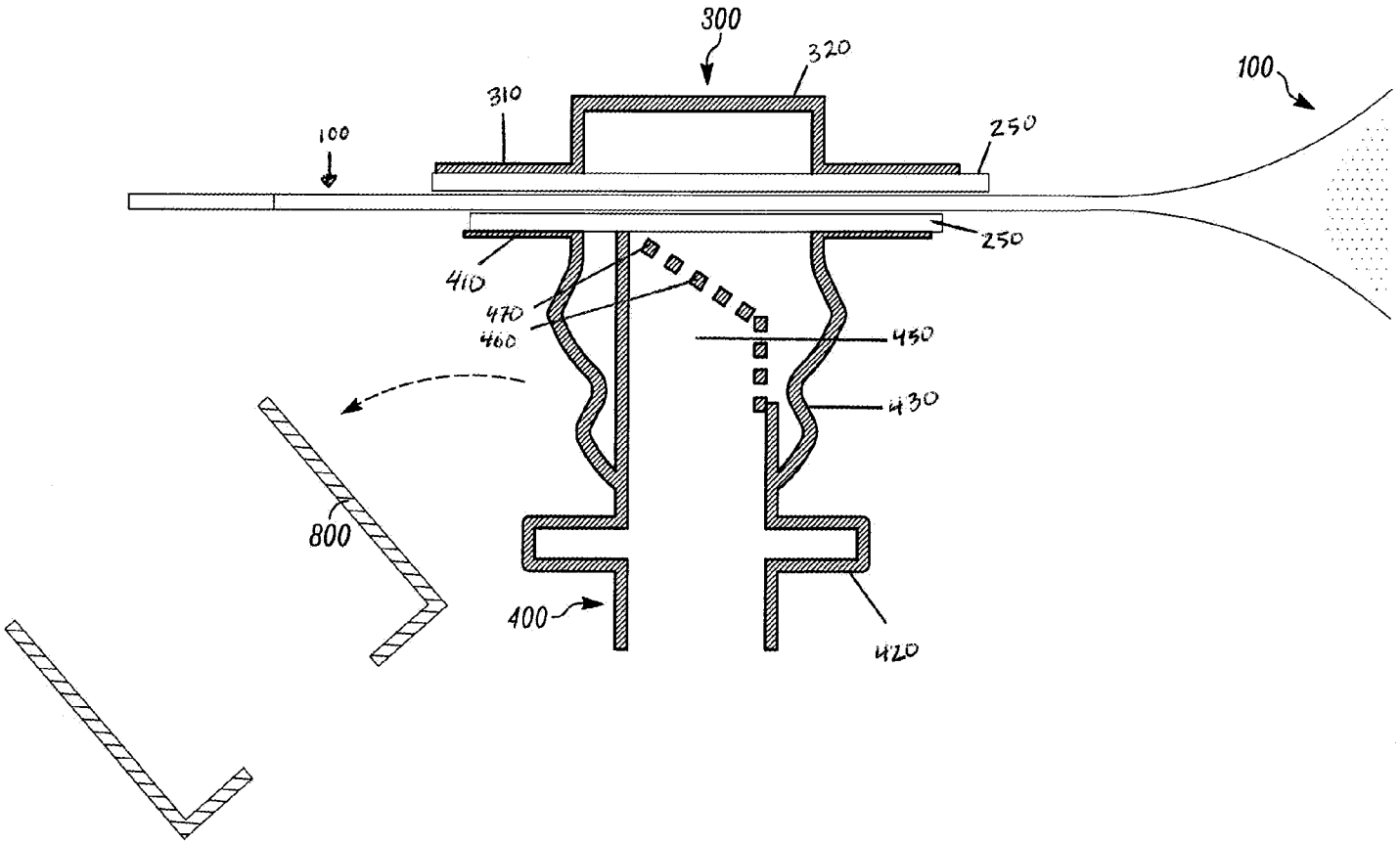
FIG. 6B is a schematic cross-sectional view of the assembled filled pouch and pouch connector of FIG. 6A after removal of the safety or locking ring.

FIG. 6B is a schematic cross-sectional view of the assembled filled pouch 100 and pouch connector 200 of FIG. 6A after removal of the safety ring 800. As shown in FIG. 6B, with the safety ring 800 removed, the actuating portion 420 of the main connector 400 may be actuated, the body portion 430 compressed and the piercing member 450 allowed to pierce a portion of the pouch 100. In some embodiments, the safety ring 800 remains on the main connector 400 for the life of the pouch connector 200 and is removed by a user prior to dispensing of the substance 110. In some other embodiments, the safety ring 800 includes a frangible portion, frangibly connected to pouch connector 200, and frangibly removable therefrom.

Figure 7B:
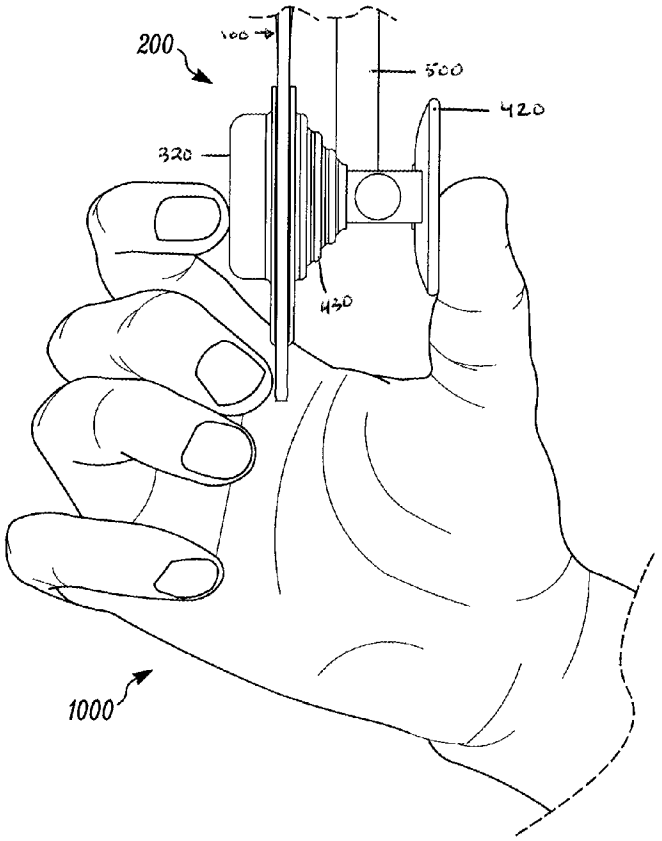
FIG. 7B is a perspective view of the assembled filled pouch and pouch connector of FIG. 7A after manually moving the actuator and piercing member from the disengaged into the engaged position piercing the pouch and placing the connector in fluid communication with the interior of the pouch.
Figure 7A:
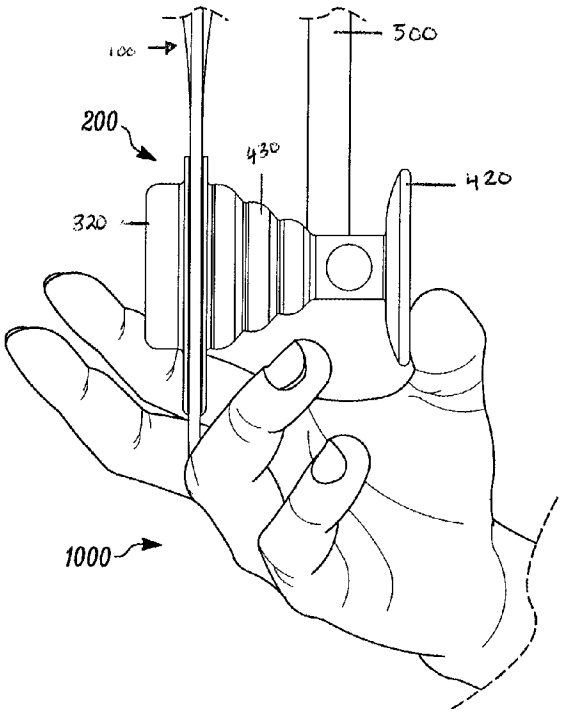
FIG. 7A is a perspective view of the assembled filled pouch and pouch connector of FIG. 6B with the locking or safety ring removed, but the piercing member in the disengaged position and ready for manual actuation into the engaged position to pierce the pouch.

With the safety ring 800 removed, a user 1000 (e.g., a physician, nurse, health care provider, server, consumer, etc.) may then grasp the safety cap 300 and the main connector 400 to actuate the pouch connector 200. FIG. 7A is a schematic perspective view of the assembled filled pouch 100 and pouch connector 200 of FIG. 6B in an initial position. The user 1000 may grasp the pouch connector 200 by placing an index finger on stop surface 320 of safety cap 300 and a thumb on the actuating portion 420 of the main connector 400. At this point, the pouch connector 200 is in an initial position with the pouch 100 disposed between the safety cap 300 and the main connector 400. FIG. 7B is a schematic perspective view of the assembled filled pouch 100 and pouch connector 200 after the user 1000 has placed the pouch connector of FIG. 7A in an actuated position. By pressing the main connector 400 against the safety cap 300, the piercing member 450 is able to puncture the pouch 100.

Figure 7D:
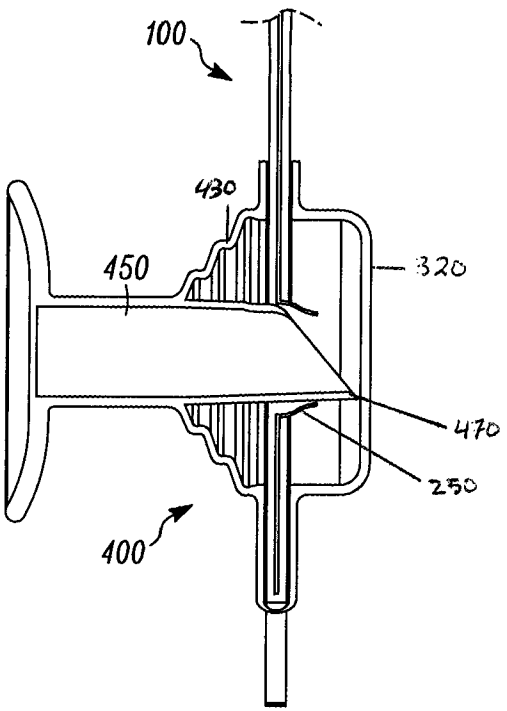
FIG. 7D is a schematic cross-sectional view of the assembled filled pouch and pouch connector of FIG. 7C in the fully actuated or engaged position.
Figure 7C:
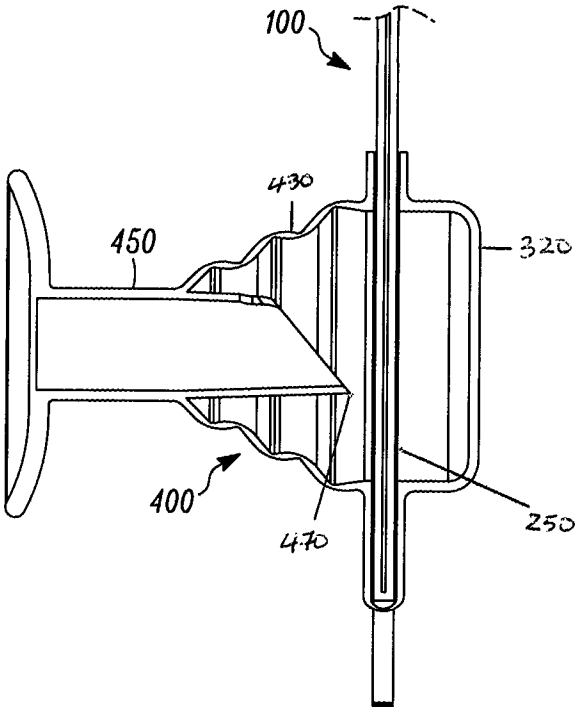
FIG. 7C is a perspective cross-sectional view of an assembled filled pouch and pouch connector in the disengaged position.

FIGS. 7C and 7D are schematic cross-sectional views of the assembled filled pouch 100 and pouch connector 200 in the initial and actuated position. As can be appreciated from these figures, the piercing member 450 is manually engaged in the actuated position to pierce the pouch 100. In some embodiments, the piercing member 450 pierces a first surface of the pouch 100. The piercing member 450 may also pierce the first surface and further pierce a second surface or second side of the pouch 100. In some embodiments, the piercing member 450 is pushed through the pouch 100 and against the stop surface 320 of safety cap 300 which is sufficiently strong and resilient to prevent the piercing member from penetrating it.

It will be understood that the configuration of the piercing member 450 and the pouch connector 200 as a whole may be varied in a number of ways. For example, instead of axial actuation, the main connector 400 may be configured as a threaded combination. A body portion 430 of the main connector 400 may include a female thread while the actuating member 420 includes a complementary male thread. To actuate, the actuating member 420 may be rotated relative to the body portion 430 of the main connector 400 so that the threads are advanced. By rotating the actuating member 420, the piercing member 450 may be advanced to pierce the pouch 100 and provide fluid communication between the pouch 100 and a dispensing line 500 or valve 600.

FIG. 8 is a schematic perspective view of the assembled filled pouch 100 and pouch connector 200 after the pouch connector 200 has been actuated showing dispensing of a substance 110. Piercing of the pouch 100 allows the substance 110 to flow from the pouch through the pierced portion, through the pouch connector 200 and to a dispensing line 500 or other dispensing valve 600 as needed. The line 500 may be connected to any type of aseptic valve or pump as described, to dispense a metered dose to a patient, consumer or user. Using the pouch connector 200, sterility is maintained inside the pouch 100 during the entirety of the shelf-life of the substance 110. Moreover, the outflow of the substance 110 is controlled so that the substance 110 is dispensed only after the user 1000 actuates the pouch connector 200. Using the pouch connector 200, the risk of leakage and/or exposure of the substance 110 to the environment is minimized. Furthermore, because of the configuration of the safety cap 300, there is no risk to the user of injury (e.g., by accidentally contacting the piercing member 450).

One advantage of the present invention is that the same product may remain shelf-stable in the pouch, whether refrigerated or not, throughout the shelf life and usage of the pouch. Accordingly, the present invention is particularly suitable for storing and dispensing ready-to-drink products, including non-acid products, such as those that are generally difficult to preserve upon opening of the package, including without limitation, drinks such as wine, milk-containing drinks, cocoa-based drinks, malt based drinks, tea, coffee, coffee concentrate, tea concentrate, other concentrates for making beverage or food products, sauces, such as cheese and milk, or meat-based sauces, gravies, soups, and nutritional drink supplements, meal replacements, baby formulas, milks, growing-up milks, etc. Accordingly, a significant advantage of the currently preferred embodiments of the present invention is that they allow the above-mentioned and any of numerous other products to be distributed and stored at an ambient temperature and allow the product to remain shelf-stable even after dispensing product from the pouch, whether refrigerated or not. However, for certain products it may be desirable to refrigerate the product to provide a better taste, to provide the product at a desired or customary temperature, or for any of numerous reasons that are currently known or that later become known.

The pouch 100 and pouch connector 200 may be modified in combination with subject matter disclosed in U.S. patent application Ser. No. 11/295,274, filed Dec. 5, 2005, entitled "One-Way Valve And Apparatus Using The Valve", U.S. patent application Ser. No. 11/295,251, filed Dec. 5, 2005, entitled "Method Of Using One-Way Valve And Related Apparatus", U.S. Provisional Patent Application Ser. No. 60/633,332, filed Dec. 4, 2004, U.S. Provisional Patent Application Ser. No. 60/644,130, filed Jan. 14, 2005, both of which are entitled "One-Way Valve, Apparatus and Method of Using the Valve", U.S. Provisional Patent Application Ser. No. 60/757,161, filed Jan. 5, 2006, and U.S. Provisional Patent Application Ser. No. 60/843,131, filed Sep. 9, 2006, both of which are entitled "One-Way Valve and Apparatus and Method of Using the Valve". Each of the foregoing patent applications is hereby incorporated by reference in its entirety as part of the present disclosure.

The pouch 100 and pouch connector 200 may further be modified to include one or more penetrable and resealable members, penetrable by a needle or injection member for aseptically filling pouch 100, wherein the resulting penetration aperture is resealable by radiation or laser energy, or by a liquid sealant, such as liquid silicone, in accordance with the teachings of the following patents and co-pending patent applications that are hereby expressly incorporated by reference as part of the present disclosure: U.S. Pat. No. 6,604,561, entitled "Medicament Vial Having a Heat-Sealable Cap, and Apparatus and Method for Filling the Vial"; U.S. Pat. No. 6,684,916, entitled "Medicament Vial Having a Heat-Sealable Cap, and Apparatus and Method for Filling the Vial"; U.S. patent application Ser. No. 10/694,364, filed Oct. 27, 2003, entitled "Medicament Vial Having a Heat-Sealable Cap, and Apparatus and Method for Filling the Vial"; U.S. patent application Ser. No. 10/766,172, filed Jan. 28, 2004, entitled "Medicament Vial Having a Heat-Sealable Cap, and Apparatus and Method for Filling the Vial"; U.S. patent application Ser. No. 10/600,525, filed Jun. 19, 2003, entitled "Sterile Filling Machine Having Needle Filling within E-Beam Chamber"; U.S. patent application Ser. No. 10/655,455, filed Sep. 3, 2003, entitled "Sealed Containers and Methods of Making and Filling Same"; U.S. provisional patent application Ser. No. 60/518,685, filed Nov. 10, 2003, entitled "Needle Filling and Laser Sealing Station"; U.S. patent application Ser. No. 11/070,440, filed Mar. 2, 2005, entitled "Apparatus for Needle Filling and Laser Resealing"; U.S. provisional patent application Ser. No. 61/250,363, filed Oct. 9, 2009, entitled "Device with Co-Molded Closure, One-Way Valve and Variable-Volume Storage Chamber, and Related Method"; and U.S. patent application Ser. No. 12/901,420, filed Oct. 8, 2010, entitled "Device with Co-Molded Closure, One-Way Valve and Variable-Volume Storage Chamber, and Related Method".

As may be recognized by those of ordinary skill in the pertinent art based on the teachings herein, numerous changes and modifications may be made to the above-described and other embodiments of the present invention without departing from the spirit of the invention as defined in the claims. For example, the components of the apparatus may be made of any of numerous different materials that are currently known, or that later become known for performing the function(s) of each such component. Similarly, the components of the apparatus may take any of numerous different shapes and/or configurations, additional components may be added, components may be combined, and one or more components or features may be removed.

What is claimed is:

1. A method comprising the following steps:

providing an empty, sterile pouch having a first side and a second side;

hermetically sealing a first pouch-engaging surface of a pouch connector to the first side of the pouch, and hermetically sealing a second pouch-engaging surface of the pouch connector to the second side of the pouch; and molding the pouch connector in one piece with a penetrable and resealable member that is penetrable by a needle or injection member for aseptically filling the pouch therethrough.

2. A method as defined in claim 1, wherein the hermetically sealing step is performed by using an adhesive.

3. A method as defined in claim 2, wherein the adhesive includes an ultraviolet radiation curable adhesive, and the hermetically sealing step includes applying a sufficient amount of ultraviolet radiation to cure the adhesive.

4. A method as defined in claim 3, wherein the hermetically sealing step includes applying a sufficient amount of ultraviolet radiation to sterilize with ultraviolet radiation or more of (i) any interface of the first connector and the pouch, (ii) an interior portion defined between the first connector and the pouch by walls of said first connector and the pouch; or (iii) said wall defining said interior portion.

5. A method as defined in claim 1, wherein the penetrable and resealable member is molded in one piece with the pouch connector prior to the hermetically sealing step.

6. A method as defined in claim 1, further comprising:

penetrating the penetrable and resealable member with a needle or injection member; and introducing fluid through the needle or injection member, through the penetrable and resealable member, and into the pouch, and thereby sterile filling the pouch.

7. A method as defined in claim 6, further comprising withdrawing the needle or injection member from the penetrable and resealable member and sealing a penetration aperture in the penetrable and resealable member with one or more of (i) radiation or energy or (ii) a liquid sealant.

8. A method as defined in claim 6, further comprising aseptically withdrawing the filled substance from the pouch through the pouch connector.

9. A method as defined in claim 1, further comprising connecting a sterile connector in fluid communication with the pouch connector.

10. A method as defined in claim 9, further comprising dispensing one or more doses of fluid from the interior of the pouch through the sterile connector, and maintaining the remaining fluid within the pouch sterile and sealed with respect to the ambient atmosphere.

11. An apparatus comprising:

a sterile pouch;

a pouch connector comprising a housing including a first pouch-engaging surface engaged with a first side of the pouch forming a hermetic seal therebetween, and a second pouch-engaging surface, formed integral with the first pouch-engaging surface, and engaged with a second side of the pouch opposite the first side of the pouch and forming a hermetic seal therebetween; and a penetrable and resealable member molded in one piece with the pouch connector, wherein the penetrable and resealable member is penetrable by a needle or injection member to sterile fill the pouch with a substance therethrough and a resulting penetration aperture is resealable to hermetically seal a sterile substance within an interior of the pouch.

12. An apparatus as defined in claim 11, further comprising a port coupled in fluid communication between the housing and interior of the pouch for one or more of sterile filling the substance therethrough into the interior of the pouch or dispensing the sterile filled substance therethrough from the interior of the pouch.

13. An apparatus as defined in claim 11, further comprising a conduit coupled to the pouch connector in fluid communication with the interior of the pouch, and a valve coupled in fluid communication with the conduit for controlling one or more of (i) a flow of substance from the pouch therethrough, or (ii) a flow of substance from the valve and conduit therethrough towards the housing.

14. An apparatus as defined in claim 11, wherein the penetrable and resealable member is resealable through application of one or more of (i) radiation or energy or (ii) a liquid sealant.

15. An apparatus as defined in claim 14, wherein the pouch is aseptically filled with a fluid, the penetrable and resealable member is resealed, and the fluid in the pouch is sealed with respect to the ambient atmosphere.

16. An apparatus as defined in claim 15, wherein the penetrable and resealable member is thermally resealed or is resealed by the application of a liquid sealant thereto.

17. An apparatus as defined in claim 14, wherein the interior of the pouch defines an aseptic storage chamber that is empty, sealed with respect to ambient atmosphere, and adapted to receive therein a substance to be stored and dispensed therefrom, and the penetrable and resealable portion is not resealed.

18. An apparatus as defined in claim 11, further comprising a sterile connector connected in fluid communication with the interior of the pouch.

19. An apparatus as defined in claim 18, wherein the sterile connector is either (i) formed integral with the pouch connector, or (ii) coupled through a conduit in fluid communication with the interior of the pouch.

20. An apparatus as defined in claim 11, further comprising a port in fluid communication between the penetrable and resealable member and the interior of the pouch.

21. An apparatus as defined in claim 11, wherein the penetrable and resealable member is over-molded or co-molded in one piece with the pouch connector.

22. An apparatus as defined in claim 11, wherein the pouch connector includes a fitting thereon.

23. An apparatus as defined in claim 22, further comprising a tube connected on one end to the fitting and forming a hermetic seal therebetween.

24. An apparatus as defined in claim 23, further comprising a sterile connector or valve coupled in fluid communication to another end of the tube and forming a hermetic seal therebetween.

25. An apparatus as defined in claim 11, wherein the housing includes a base portion defining the first and second pouch-engaging surfaces, and a body portion on the base portion, wherein the penetrable and resealable member is co-molded or over-molded to the body portion.

26. An apparatus as defined in claim 11, wherein the pouch connector includes one or more of an inflow port, an outflow port, a connector and a valve.

27. An apparatus as defined in claim 11, wherein the pouch connector includes an inflow port, and the penetrable and resealable member seals the inflow port with respect to the ambient atmosphere.

28. An apparatus as defined in claim 27, wherein the pouch connector further includes an outflow port and another penetrable and resealable member sealing the outflow port with respect to the ambient atmosphere.

29. An apparatus comprising:

a sterile pouch;

a pouch connector comprising a housing including a first pouch-engaging surface engaged with a first side of the pouch forming a hermetic seal therebetween, and a second pouch-engaging surface, formed integral with the first pouch-engaging surface, and engaged with a second side of the pouch opposite the first side of the pouch and forming a hermetic seal therebetween; and first means molded in one piece with the pouch connector for aseptically filling the pouch with a substance therethrough.

30. An apparatus as defined in claim 29, wherein the first means includes either (i) a penetrable and resealable member that is penetrable by a needle or other injection member for aseptically filling the pouch therethrough, or (ii) a sterile connector for aseptically filling the pouch therethrough.

31. An apparatus as defined in claim 29, further including second means for dispensing multiple doses of sterile substance from the pouch and for maintaining the remaining doses of substance in the pouch sterile and sealed with respect to the ambient atmosphere.

32. An apparatus as defined in claim 31, wherein the second means is (i) a sterile connector connected in sterile, fluid communication with the pouch connector, or (ii) a valve connected in sterile, fluid communication with the pouch connector.

* * * * *